United States Patent [19]

Röck et al.

[11] 4,167,802

[45] Sep. 18, 1979

[54] MOUNTING PLATE STRUCTURE FOR ATTACHMENT OF A FURNITURE HINGE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 853,563

[22] Filed: Nov. 21, 1977

[30] Foreign Application Priority Data

Nov. 30, 1976 [AT] Austria ..... 8868/76

[51] Int. Cl.[2] ..... E05D 7/04

[52] U.S. Cl. ..... 16/129; 16/131; 151/69; 85/83

[58] Field of Search ..... 16/129–134; 151/69; 403/4, 353

[56] References Cited

U.S. PATENT DOCUMENTS

| | | | |
|---|---|---|---|
| 3,195,600 | 7/1965 | Middleton, Jr. | 151/69 |
| 3,224,035 | 12/1965 | Heinze | 16/131 X |
| 3,892,031 | 7/1975 | Bisbing | 151/69 X |

FOREIGN PATENT DOCUMENTS

| | | | |
|---|---|---|---|
| 1459059 | 11/1968 | Fed. Rep. of Germany | 16/129 |
| 2356000 | 5/1975 | Fed. Rep. of Germany | 16/129 |
| 2460127 | 6/1976 | Fed. Rep. of Germany | 16/129 |
| 2289096 | 5/1976 | France | 16/129 |

*Primary Examiner*—James Kee Chi

*Attorney, Agent, or Firm*—Wenderoth, Lind & Ponack

[57] ABSTRACT

A hinge mounting plate is held by clamping screws on a furniture wall. The position of the mounting plate is adjustable while the plate is secured by the screws which are not fully screwed into the furniture wall, whereby the screws hold the mounting plate in an intermediate position before final clamping of the plate.

5 Claims, 9 Drawing Figures

MOUNTING PLATE STRUCTURE FOR ATTACHMENT OF A FURNITURE HINGE

BACKGROUND OF THE INVENTION

FIELD OF THE INVENTION

The present invention relates to a mounting plate, for hinges in particular, to which a hinge arm or the like can be fixed, whereby the mounting plate can be fixed directly to a piece of furniture, e.g. a side-wall of the piece of furniture, by means of fastening screws or the like projecting through fastening holes of the mounting plate, or indirectly by means of a dowel mounting plate or the like.

DESCRIPTION OF THE PRIOR ART

Mounting plates of the above mentioned kind for hinges or rigid connecting members are well-known and are frequently used in the modern furniture industry, particularly in the kitchen-furniture industry.

It is the advantage of such mounting plates that they can be fixed to the side-wall of the piece of furniture, and that a hinge arm which is fastened to a hinge casing inserted in the furniture door can be mounted by means of hinge links or the like to the mounting plate when finally assembling the piece of furniture.

In the case of suitably constructed hinge arms, these mounting plates also allow subsequent adjustment and positioning of the hinge arm, whereby compensations may be made for tolerances which may be caused when drilling fastening holes for the mounting plate, when mounting the mounting plate. In the case of modern hinges, structures generally provided for adjustment in the direction of the depth of the piece of furniture and in the door joint.

It is the object of the present invention to produce a mounting plate of the above mentioned kind which allows an adjustment in the height of the piece of furniture, in addition to the above mentioned kinds of adjustment.

The same mounting plate naturally also allows an adjustment in the depth of the piece of furniture if the mounting plate is turned by 90° before being mounted.

In general, depth adjustment can be effected in the hinge arm itself, e.g. by means of a longitudinal slot for the fastening screw, so that the height-adjustment provided by the mounting plate is an additional adjustment.

Experience has shown that not all hinges have to be adjusted in all directions after being mounted, but that the fastening holes for the mounting plate have been exactly drilled in most cases and that the mounting plate has been exactly adjusted.

Thus, if it is necessary to adjust the mounting plate in the direction of the height of the piece of furniture, whether or not the fastening holes have been drilled exactly, such height adjustment requires additional work in many cases. On the other hand, the possibility of such adjustment should be possible, if required.

SUMMARY OF THE INVENTION

In view of the above mentioned objects, the present invention provides that every mounting plate fastening screw has at the head end thereof a reduced diameter portion of a length at least equal to the depth of the fastening holes extending through the mounting plate. Each fastening screw has a larger diameter or broader portion having a diameter equal or almost equal to the diameter of the fastening holes or of an enlarged portion of the fastening holes.

It is preferably provided that the fastening holes are longitudinal slots which have on their side-walls recesses having a shape similar to circle-segments and which correspond to the broader portion of the fastening screws.

If the screws in an initial fastening position have been turned or screwed such that their larger diameter portions extend out of the mounting plate and into the side-wall of the piece of furniture, then the mounting plate may be shifted from such initial position, since only the reduced diameter portions of the screws extend through the fastening holes of the mounting plate.

A preferred embodiment provides that the fastening screws have a pin portion at their free ends. If the holes drilled into the side wall of the piece of furniture have the same diameter as the pin portions, the fastening screws can be kept in position within the holes by the pin portions, whereby the mounting plate rests against the side wall, so that any need for an adjustment or shifting of the mounting plate already becomes evident at this point of the assembly. If the fastening screws are screwed into the side wall of the piece of furniture, the screw threads cut into the walls of the holes.

Before finally fastening the screws, the pin portions and thus the fastening screws are more safely secured to the side wall of the piece of furniture by providing the pin portions with threads.

A further embodiment provides that the recesses have threaded portions corresponding to the threads of the larger diameter portions of the fastening screws.

In this embodiment the mounting plate is most safely secured before final fastening.

In the following the various embodiments of the invention will be described in more detail, with reference to the attached drawings, without being limited thereto.

DESCRIPTION OF THE PREFERRED EMBODIMENTS

Figure 1:
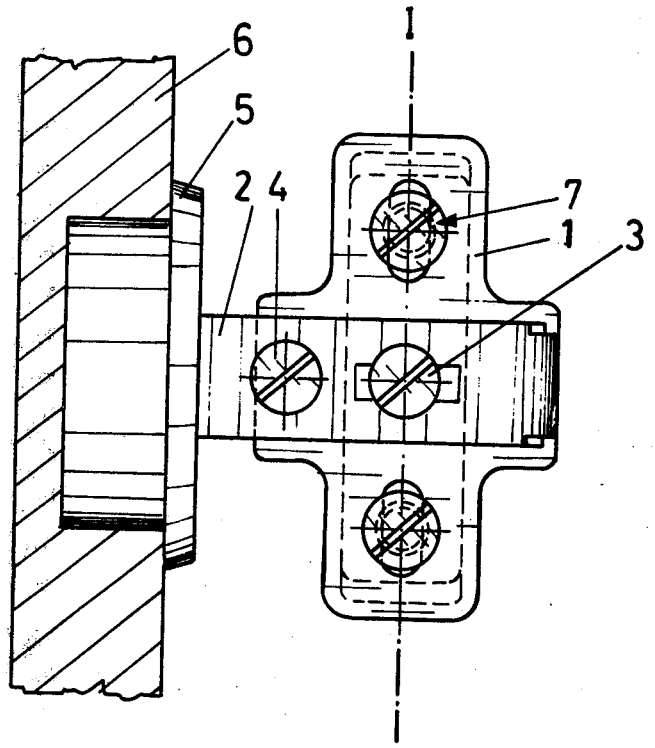
FIG. 1 is an elevation view of a hinge with a mounting plate according to the invention, taken in the direction of the side wall of the piece of furniture, whereby the hinge links connecting the hinge casing and the hinge arm are not illustrated and whereby the hinge is closed.

As can be seen in the figures of the drawings, a hinge arm 2, which is kept in position by a fixing screw 3 and which is supported by an adjusting screw 4, is mounted on the mounting plate 1 according to the invention, when in assembled position. The hinge arm 2 is connected with a hinge casing 5 which is inserted into the door 6 by means of hinge links, not illustrated.

The mounting plate 1 is secured to the side wall 8 of the piece of furniture by means of fastening screws 7. The fastening screws 7 each have a reduced diameter portion adjacent the respective head 9, so that a narrower bolt portion 10 is formed. Adjacent to narrower bolt portion 10 lies a broader bolt portion 13 whose diameter d corresponds to the diameter D of the enlarged portion of the fastening holes 11.

According to the illustrated embodiments, the fastening holes 11 are longitudinal 11' slots which have on their side walls recesses 12' having a shape similar to a circle-segment. Recesses 12 are positioned opposite to each other and form the enlarged portion of the fastening holes 11.

The recesses 12 have threaded portions corresponding to the thread of the broader bolt portion 13. The fastening screws 7 can, therefore, be screwed into the enlarged portion of the fastening holes 11, whereby the mounting plate 1 and screws 7 assume the position as illustrated in FIGS. 2*a*, 3*a* and 4*a*.

In this position the mounting plate 1 can be mounted on the side-wall 8 of the piece of furniture and provisionally be secured within the holes 15 of the side wall 8 of the piece of furniture by means of the free ends 7' of the fastening screws 7.

Figure 2A:
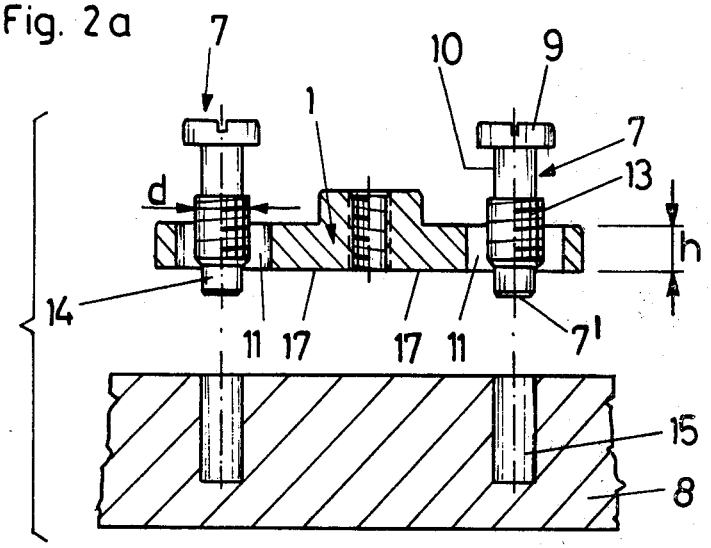
FIGS. 2*a* through 4*b* are sections taken approximately along line I—I of FIG. 1 illustrating three embodiments of a mounting plate according to the invention, with the mounting plate being shown disassembled in FIGS. 2*a*, 3*a* and 4*a*, and with the mounting plate being shown assembled in FIGS. 2*b*, 3*b* and 4*b*.
Figure 2B:
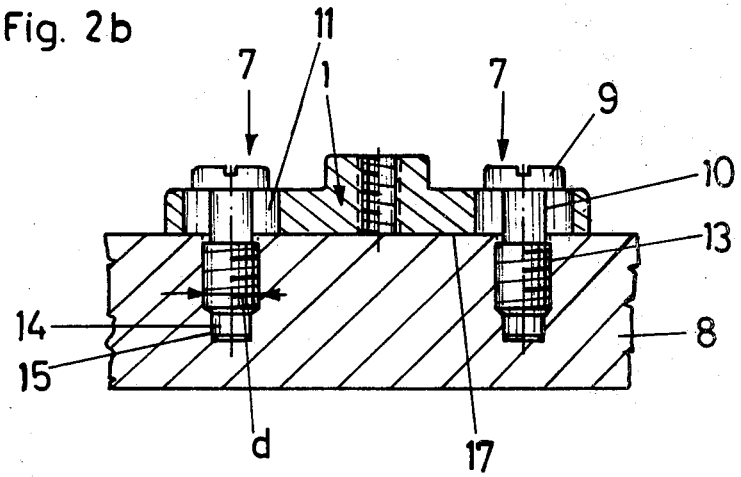
Figure 3A:
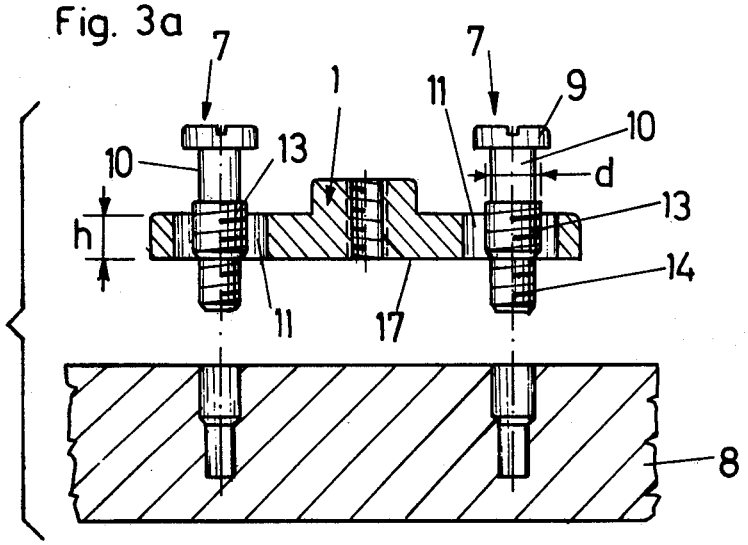
Figure 3B:
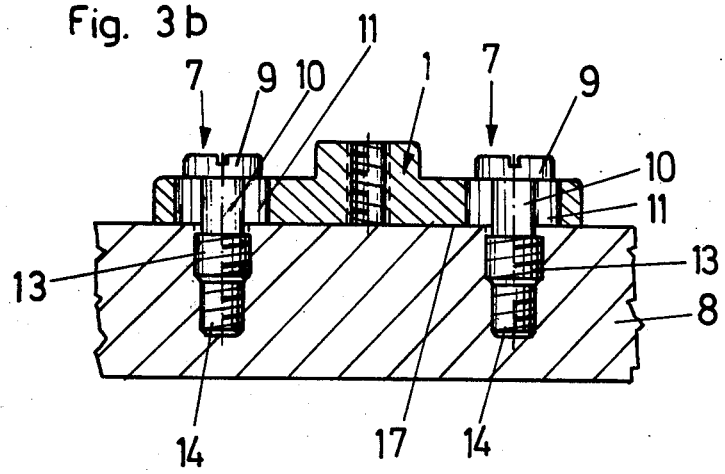

It is of advantage if, as illustrated in FIGS. 2 and 3, the fastening screws 7 have pins 14 whose diameter is equal to the diameter of the holes 15 drilled into the side wall 8. The pins 14 can be formed with (FIGS. 3*a* and 3*b*) or without (FIGS. 2*a* and 2*b*) thread. Also, the holes 15 can be drilled into the side-wall of the piece of furniture, with the holes 15 having (FIGS. 2*a* and 2*b*) or not having (FIGS. 3*a* and 3*b*) the same continuous and uniform diameter as the pin 14. The latter is of particular advantage if the pins 14 have a thread.

Figure 4A:
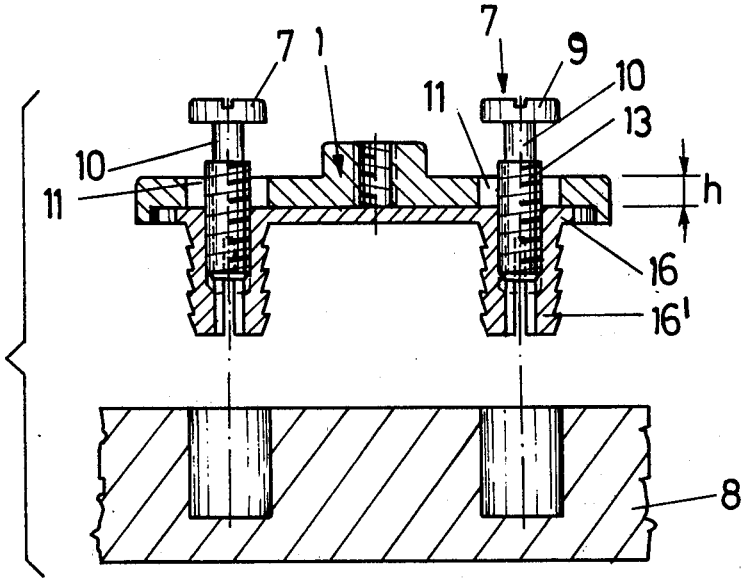
Figure 4B:
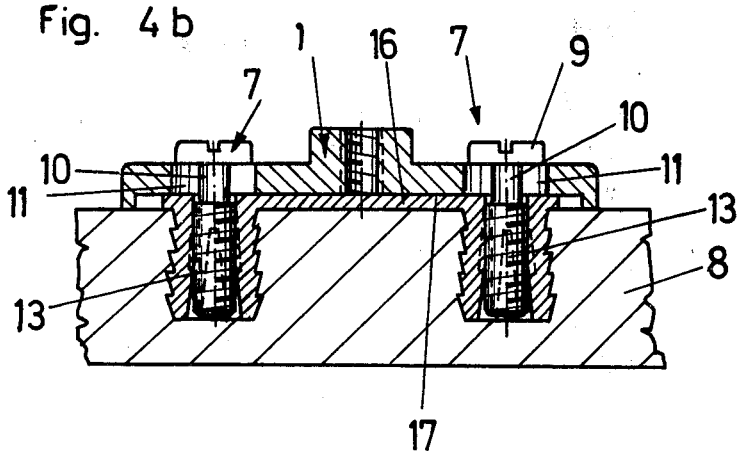
Figure 5:
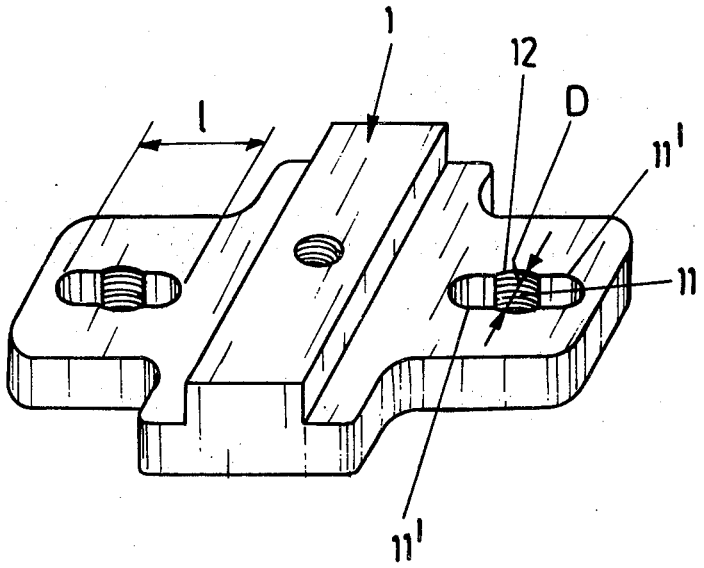
FIG. 5 is a perspective view of the mounting plate.
Figure 6:
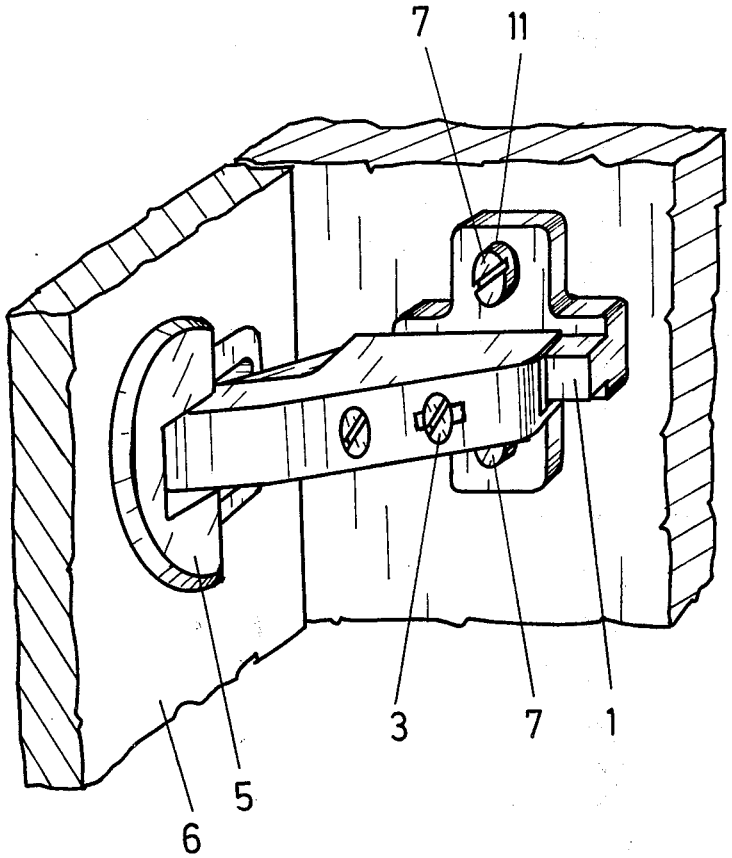
FIG. 6 is a perspective view of a hinge according to the invention when mounted on furniture parts.

FIGS. 4*a* and 4*b* illustrate an embodiment in which the mounting plate 1 rests on a dowel mounting plate 16. Dowel mounting plate 16 hase dowel pins 16' projecting therefrom into the holes 15 of the side wall 8 of the piece of furniture. The broader portions 13 of the fastening screws 7 thread into dowel pins 16'.

Assembly of the mounting plate 1 according to the invention is carried out as follows:

The fastening screws 7 are screwed into the mounting plate 1 until they are positioned as illustrated in FIGS. 2*a*, 3*a* and 4*a* (according to the embodiment in FIGS. 4*a* and 4*b*, the dowel mounting plate 16 can, as illustrated, be mounted on the mounting plate 1 or on the side wall 8 of the piece of furniture).

As already described, the tips of the fastening screws 7 of the mounting plate 1 are subsequently inserted into the holes 15 of the side wall 8 of the piece of furniture. When the mounting plate is in correct position, the fastening screws 7 are fastened by being screwed down one after the other to such an extent that the head of each fastening screw 7 is positioned close to the mounting plate 1. The mounting plate 1 is thus secured in position (FIGS. 2*b*, 3*b*, 4*b*).

If, however, the mounting plate 1 has to be shifted into correct position, the fastening screws 7 are only screwed into the side-wall 8 of the piece of furniture to such an extent that the broader portions 13 are positioned below the mounting surface 17 of the mounting plate 1 and that heads 9 do not yet lock the mounting plate 1 in its position. Thereby, only the narrower portions 10 of the fastening screws 7 are within the fastening hole 11, so that the mounting plate 1 can be shifted over the length 1 of the fastening holes 11. When the desired adjustment has been effected, the fastening screws 7 are further screwed down and fastened and by means of their heads 9 they lock the mounting plate 1 in position.

Further parts of the hinge, such as hinge casing 5, hinge links and devices for adjusting the hinge arm on the mounting plate are not described in more detail as they are not the object of the present invention.

We claim:

1. A mounting plate structure for attaching a hinge arm of a hinge to a piece of furniture, said structure comprising:

a mounting plate adapted to be attached to a piece of furniture, said mounting plate including means cooperable with a hinge arm of a hinge for attachment of such hinge to said mounting plate;

said mounting plate having extending therethrough at least two fastening holes, each said fastening hole comprising an elongated slot having opposite longitudinally extending side walls, said side walls having therein recesses in the shape of circular segments, said recesses facing each other to form an enlarged portion of the respective said fastening hole;

fastening screw means for extending through respective said fastening holes and for attaching said mounting plate to the piece of furniture, each said fastening screw means including a head, a threaded larger diameter portion, and a reduced diameter portion separating said head from said larger diameter portion;

each said larger diameter portion having a diameter substantially equal to the size of said enlarged portion of the respective said fastening hole, such that said larger diameter portion may be passed through said respective fastening hole;

each said head having a size greater than said enlarged portion of said respective fastening hole, said head comprising means for abutting against said mounting plate and locking said mounting plate in position with respect to the piece of furniture; and each said reduced diameter portion having a length at least equal to the depth of said respective fastening hole and a diameter less than the width between said opposite side walls of said respective fastening hole, such that when said larger diameter portions are extended through the respective said fastening holes and into attaching relation with respect to the piece of furniture, and when said heads are slightly released from abutment with said mounting plate, then said reduced diameter portions extend throughout the entire depth of said respective fastening holes, and said mounting plate is selectively adjustably movable with respect to the piece of furniture in directions parallel to said elongated slots of said fastening holes.

2. A structure as claimed in claim 1, wherein each said fastening screw means has at the free end thereof opposite the respective said head a reduced diameter tip portion, said tip portions forming means for positioning said fastening screw means in holes formed in the piece of furniture.

3. A structure as claimed in claim 2, wherein said tip portions are threaded.

4. A structure as claimed in claim 1, wherein said recesses forming said enlarged portions of said fastening holes have threads which are complementary to the threads of the respective said larger diameter portions.

5. A structure as claimed in claim 1, further comprising a dowel mounting plate adapted to be positioned between said mounting plate and the piece of furniture, said dowel mounting plate having extending therefrom dowels adapted to be positioned in holes formed in the piece of furniture, said dowels having openings extending therethrough, said openings being internally threaded to receive said threaded larger diameter portions of said fastening screw means, said openings having an internal configuration such that when said larger diameter portions are completely threaded therein said dowels are spread outwardly.

* * * * *